US007128010B2

(12) United States Patent
Robinson et al.

(10) Patent No.: US 7,128,010 B2
(45) Date of Patent: Oct. 31, 2006

(54) CBTF SAILING YACHT APPENDAGE RETRACTION SYSTEM

(75) Inventors: Charles W. Robinson, Sante Fe, NM (US); William F. Burns, III, San Diego, CA (US)

(73) Assignee: CBTF Co., San Diego, CA (US)

( * ) Notice: Subject to any disclaimer, the term of this patent is extended or adjusted under 35 U.S.C. 154(b) by 0 days.

(21) Appl. No.: 10/840,868

(22) Filed: May 7, 2004

(65) Prior Publication Data

US 2004/0206287 A1 Oct. 21, 2004

Related U.S. Application Data

(63) Continuation-in-part of application No. 10/793,151, filed on Mar. 4, 2004, now Pat. No. 6,951,180, and a continuation-in-part of application No. 10/646,326, filed on Aug. 22, 2003, now abandoned.

(60) Provisional application No. 60/440,453, filed on Jan. 15, 2003.

(51) Int. Cl.
*B63B 41/00* (2006.01)

(52) U.S. Cl. ..... 114/128; 114/129; 114/132; 114/138; 114/143

(58) Field of Classification Search ..... 114/127, 114/129, 130, 132, 135, 136, 138, 141, 143, 114/163

See application file for complete search history.

(56) References Cited

U.S. PATENT DOCUMENTS

| | | | | | |
|---|---|---|---|---|---|
| 352,490 | A | * | 11/1886 | Shears | 114/128 |
| 421,008 | A | * | 2/1890 | Martin | 114/129 |
| 3,381,648 | A | * | 5/1968 | Vonck | 114/138 |
| 3,951,090 | A | * | 4/1976 | Potter | 114/141 |
| 4,759,308 | A | * | 7/1988 | Zander | 114/127 |
| 5,163,377 | A | * | 11/1992 | Calderon et al. | 114/39.25 |
| 5,280,760 | A | * | 1/1994 | Edwards | 114/39.15 |

* cited by examiner

*Primary Examiner*—Sherman Basinger
(74) *Attorney, Agent, or Firm*—Loyal McKinley Hanson

(57) ABSTRACT

A canting ballast twin foil (CBTF) sailing yacht constructed according to the invention includes a sailing hull, a laterally moveable ballast suspended beneath the hull that provides a counter heeling force when the yacht is underway, and fore and aft foils that provide improved leeway control and ballast. Components are included for at least partially retracting into the hull at least one of the ballast-supporting strut, the fore foil, and the aft foil.

5 Claims, 12 Drawing Sheets

CBTF SAILING YACHT APPENDAGE RETRACTION SYSTEM

CROSS REFERENCE TO RELATED APPLICATIONS

This application is a continuation in part of U.S. patent application Ser. No. 10/793,151 filed Mar. 4, 2004 (the parent application that issued as U.S. Pat. No. 6,951,180 B2 on Oct. 4, 2005). Said parent application is a continuation in part of U.S. patent application Ser. No. 10/646,326 filed Aug. 22, 2003 (the grandparent application which is now abandoned). Said grandparent application claims the benefit of U.S. Provisional Application Ser. No. 60/440,453 filed Jan. 15, 2003.

BACKGROUND OF THE INVENTION

1. Technical Field

This invention relates generally to sailing yachts, and more particularly to a high performance sailing yacht having a laterally moveable ballast suspended beneath the hull that provides a counter heeling force when the yacht is underway, together with forward and aft foils that provide improved leeway control.

2. Description of Related Art

U.S. Pat. Nos. 5,163,377 and 5,622,130 describe various aspects of a keel-less sailing yacht that has fore and aft cambered foils for leeway control and a dynamic gravitational ballast for heeling resistance. A ballast-supporting structure, in the form of an elongated strut extending downwardly from the hull, supports the ballast generally beneath the hull. Twin fore and aft rotatable foils are also supported by the hull with extension below the hull for optimum performance under a wide range of operating conditions, preferably being controlled by a hydraulic or electric system.

A keel-less sailing yacht with appendages in the form of a movable ballast-supporting strut and twin fore and aft foils is sometimes referred to as a canting ballast twin foil (CBTF) sailing yacht. Such CBTF sailing yachts enjoy recognized sailing success accompanied by significant interest in CBTF technology. However, various structural and operational concerns need attention.

For example, the downwardly depending foils and ballast-supporting strut hinder operations in shallower water. In addition, replacement of foils damaged by vessel grounding is impaired. Furthermore, operating performance of larger sailing yachts, including those designed for ocean racing or cruising, can suffer somewhat under various sailing conditions (e.g., sailing off wind) due to the friction drag introduced by the downwardly depending appendages. Thus, a need exists for CBTF improvements in these respects.

SUMMARY OF THE INVENTION

It is the object of this invention to enhance performance of prior art CBTF sailing yachts. This objective is achieved by providing a CBTF sailing yacht having means for retracting one or more of the appendages. When sailing off wind, for example, side force is lower and so the need for the full surface area of the fore and aft foils to control leeway is reduced. As a result, retraction of either or both foils into the hull is allowable to reduce or even eliminate any extension of these foils below the hull. The resulting reduction in surface area improves sailboat performance by lowering form and friction drag. Retraction of foils (combined with retraction of the ballast-supporting strut) reduces vessel draft, thereby allowing operations in shallower water and also facilitating replacement of foils if damaged by vessel grounding.

In addition, when sailing off wind there is less vessel heeling moment so that reduction in the ballast counter heeling force by retracting the ballast-supporting strut into the hull is allowable. Retraction improves sailboat performance by reducing form and friction drag. It also reduces vessel draft, thereby allowing operation in shallower water.

To paraphrase some of the more precise language appearing in the claims and introduce the nomenclature used, a sailing yacht constructed according to the invention includes a sailing hull. Means are provided on the hull for moveably supporting a ballast beneath the hull, including a moveable ballast-supporting strut. A fore foil is mounted on the hull for rotation about a fore axis that extends below the hull in a position forward of the ballast-supporting strut. An aft foil is mounted on the hull for rotation about an aft axis that extends below the hull in a position rearward of the ballast-supporting structure.

According to a major aspect of the invention, means are included for at least partially retracting into the hull at least one of the ballast-supporting strut, the fore foil, and the aft foil while underway. The illustrated embodiment includes all three. First means are provided for retracting the ballast-supporting strut under operator control, including a ballast-strut-retracting assembly. Second means are provided for retracting the fore foil under operator control, including a fore-foil-retracting assembly. Third means are provided for retracting the aft foil under operator control, including an aft-foil-retracting assembly.

The illustrated embodiment also includes sealed bushings that enable retraction at least partially into the hull. Based upon the foregoing and subsequent descriptions, one of ordinary skill in the art can readily implement a CBTF sailing yacht with an onboard appendage retraction system. It may be powered electrically, hydraulically, or by other suitable means. It may derive power from the main engine. Computerized operator controls may be included.

Thus, the invention provides a sailing yacht with structural improvements that overcome some significant disadvantages of prior art canting ballast and foil systems while providing functionality that enhances sailing yacht operation. The following illustrative drawings and detailed description make the foregoing and other objects, features, and advantages of the invention more apparent.

DESCRIPTION OF THE PREFERRED EMBODIMENTS

The description of the preferred embodiments begins with a description of a ballast drive system for a canting ballast twin foil (CBTF) sailing yacht in a Ballast Drive System section of the description that refers to FIGS. 1–5 of the drawings. That information is followed by information about using the main engine drive system for the ballast drive and for the fore and aft foils in a Main Engine Drive System section of the description that refers to FIGS. 6–8. The present invention is described thereafter in an Appendage Retraction System section of the description that refers to FIGS. 6, 9, 10, 11, and 12. A reader already familiar with the information presented in the first two sections and FIGS. 1–8, may proceed directly to the Appendage Retraction System section.

Figure 1:
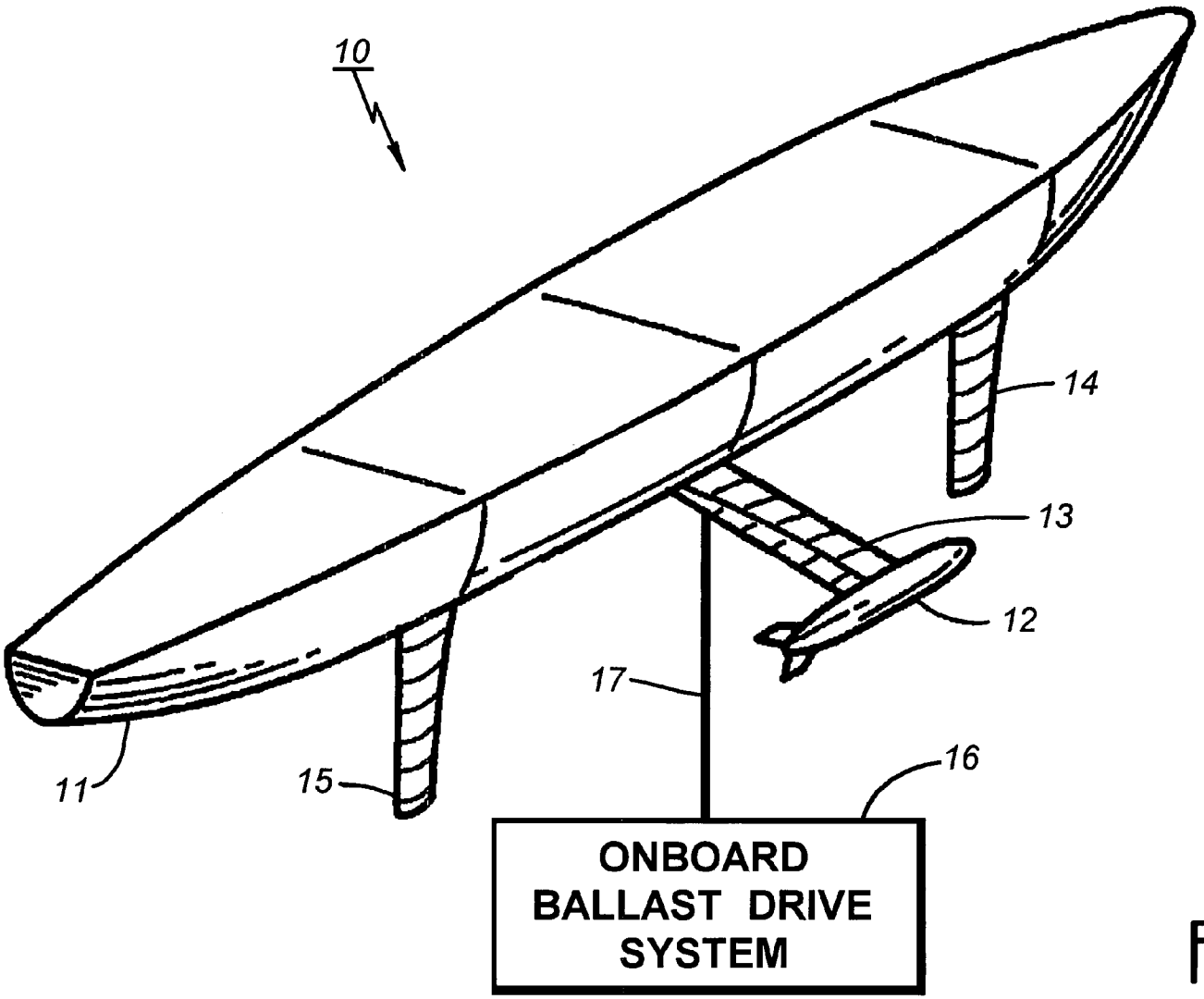
FIG. 1 of the drawings is a diagrammatic representation of a canting ballast twin foil (CBTF) sailing yacht with an onboard ballast drive system.
Figure 2:
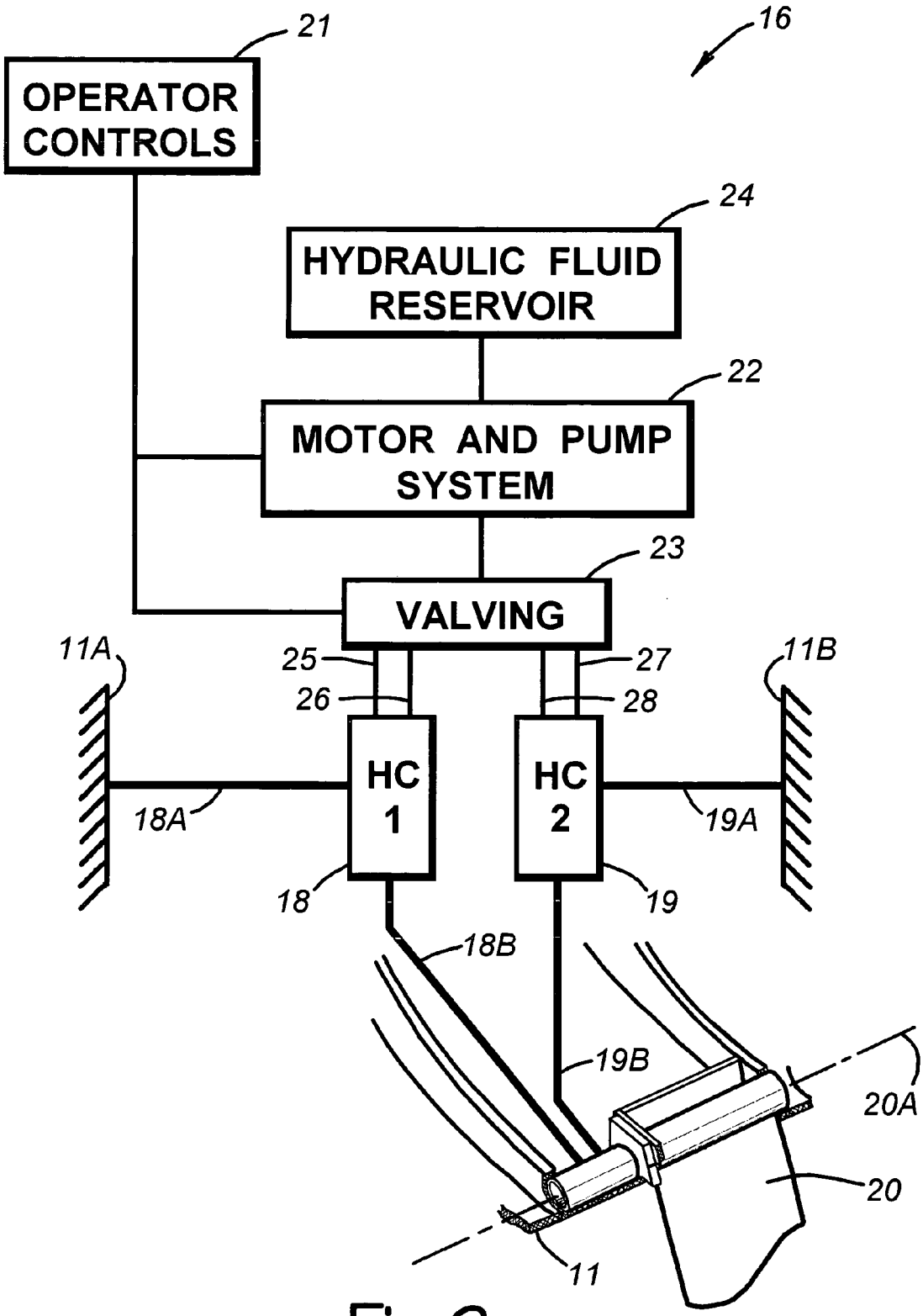
FIG. 2 is a perspective view of a strut portion of the ballast-supporting structure together with a block diagram of the ballast drive system.

Ballast Drive System. FIGS. 1–5 of the drawings show various aspects of a sailing yacht 10 constructed according to the invention. Generally, the sailing yacht 10 includes a sailing hull 11, a ballast 12, a moveable ballast-supporting structure 13, and fore and aft foils 14 and 15 (FIGS. 1 and 2). Those components operate in some respects according to known canting ballast twin foil (CBFT) operation, and additional known components of the sailing yacht 10 are not shown for illustrative convenience. Reference may be made to U.S. Pat. Nos. 5,163,377 and 5,622,130 for further details of a keel-less CBFT sailing yacht that has fore and aft cambered foils for leeway control and a dynamic gravitational ballast for heeling resistance.

The ballast-supporting structure 13 is said to function as means for supporting the ballast 12 beneath the sailing hull 11 moveably in order to produce a counter-heeling force that can be varied underway by moving the ballast-supporting structure 13. The sailing yacht 10 also includes a ballast drive system 16 onboard the sailing hull 11 for that purpose as depicted in block diagram form in FIGS. 1 and 2. The ballast drive system 16 is mechanically connected to the ballast-supporting structure 13, as depicted by a bold line 17 in FIG. 1, and it functions as means for moving the ballast-supporting structure 13 in order to move the ballast 12 and thereby vary the counter-heeling force. An operator can control ballast position with the ballast drive system 16 while underway for maximum righting moment, safety, and shock mitigation.

Any of various drive mechanisms may be used to perform that function, including a hydraulic form of ballast drive system. The drive system 16 is such a hydraulic drive system as depicted in block diagram form in FIG. 2. The hydraulic ballast drive system 17 includes at least two hydraulic cylinders. They are identified in FIG. 2 as a first hydraulic cylinder 18 and a second hydraulic cylinder 19. They may take the form of known components and they are installed as multiple hydraulic cylinders connected to the hull 11 and a strut portion 20 of the ballast-supporting structure 13 in order to provide greater force and redundancy that helps avoid catastrophic failure underway.

Preferably, the first and second hydraulic cylinders 18 and 19 are connected to different portions of the hull 11 for better force distribution. Thus, the first hydraulic cylinder 18 is mechanically connected to a first portion 11A of the hull 11, as depicted in FIG. 2 by a bold line 18A, and to the strut portion 20, as depicted by a bold line 18B. Similarly, the second hydraulic cylinder 19 is mechanically connected to a second portion 11B of the hull 11, as depicted in FIG. 2 by a bold line 19A, and to the strut portion 20, as depicted by a bold line 19B. That arrangement provides a better distribution of the forces transmitted by the first and second hydraulic cylinders 18 and 19 to the hull 11.

In operation, an operator uses operator controls 21 to control a motor and pump system 22 and valving 23 to control the flow of hydraulic fluid from a hydraulic fluid reservoir 24 to the first and second hydraulic cylinders 18 and 19. The motor and pump system 22 is operatively connected to the two hydraulic cylinders 18 and 19 via the valving 23 and it includes at least two hydraulic pumps (not individually shown) in order to provide hydraulic pump redundancy. Individual pumps are not shown for illustrative convenience, but they may take the form of known hydraulic components.

Hydraulic fluid pumped by the motor and pump system 22 to the first hydraulic cylinder 18 via the valving 23 and a first hydraulic line 25 causes the first hydraulic cylinder 18 to extend, while hydraulic fluid pumped by the motor and pump system 22 to the first hydraulic cylinder 18 via the valving 23 and a second hydraulic line 26 causes the first hydraulic cylinder 18 to retract. Similarly, hydraulic fluid pumped by the motor and pump system 22 to the second hydraulic cylinder 19 via the valving 23 and a third hydraulic line 27 causes the second hydraulic cylinder 19 to extend, while hydraulic fluid pumped by the motor and pump system 22 to the second hydraulic cylinder 19 via the valving 23 and a fourth hydraulic line 27 causes the second hydraulic cylinder 19 to retract. As they extend and retract under operator control that way, the first and second hydraulic cylinders 18 and 19 cause the strut portion 20 to pivot about a pivotal axis 20A in order to thereby move (or swing) the ballast-supporting structure 13 and the ballast 12 to a desired position relative to the hull 11. Based upon the foregoing and subsequent descriptions, one of ordinary skill in the art can readily implement a CBTF sailing yacht with an onboard ballast drive system.

Figure 3:
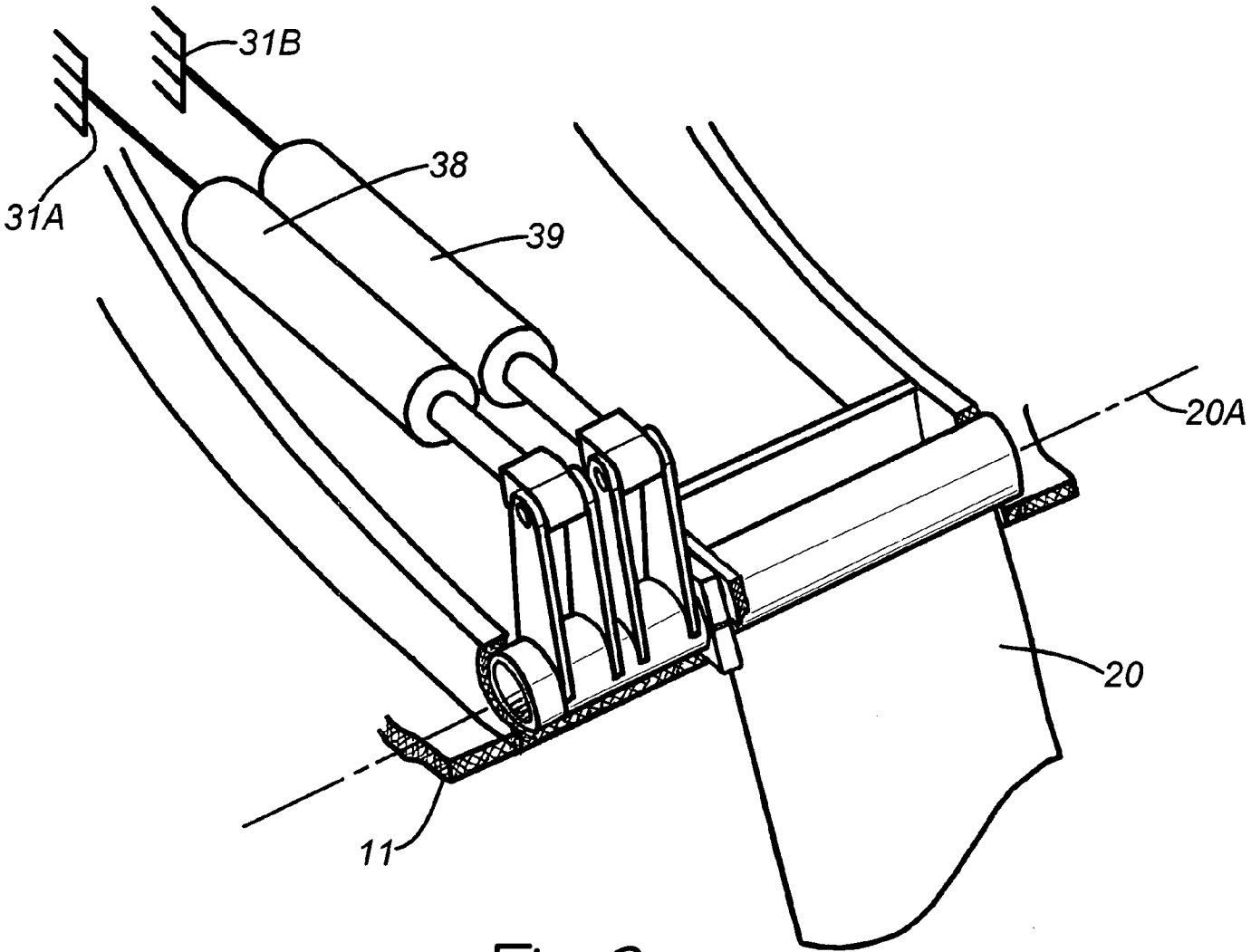
FIG. 3 is a perspective view of the strut portion of the ballast-supporting structure along with dual hydraulic cylinders arranged for parallel operation.

Turning now to FIG. 3, it shows first and second hydraulic cylinders 38 and 39 connected to the strut portion 20 and to first and second hull portions 31A and 31B as described for the first and second hydraulic cylinders 18 and 19 in FIG. 2. They are also connected by hydraulic lines and to the valving 23, but those details are omitted for illustrative convenience. The first and second hydraulic cylinders 38 and 39 are arranged for parallel operation. They extend together and retract together. In the event one cylinder fails (including failure of hydraulic line coupling hydraulic fluid to it or the related pump and/or valving), the other cylinder assumes the full load. This redundancy helps avoid catastrophic failure underway.

Figure 4:
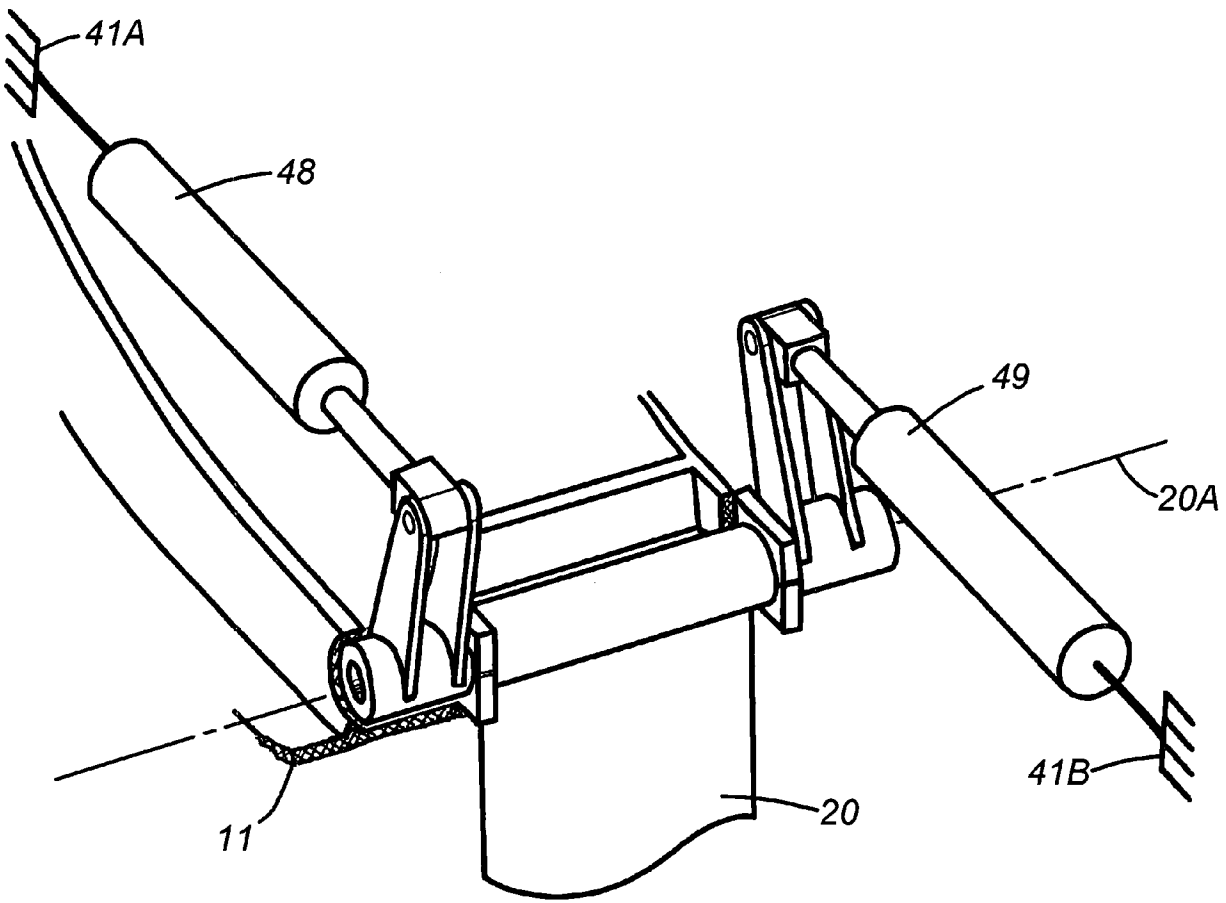
FIG. 4 is a perspective view of the strut portion with dual hydraulic cylinders arranged for push-pull operation.

FIG. 4 shows first and second hydraulic cylinders 48 and 49 connected to the strut portion 20 and to first and second hull portions 41A and 41B as described for the first and second hydraulic cylinders 18 and 19 in FIG. 2. They are also connected by hydraulic lines and to the valving 23, and those details are omitted for illustrative convenience. The first and second hydraulic cylinders 48 and 49 are arranged for push-pull operation. As the first one extends, the second one retracts. As the first one retracts, the second one extends.

Figure 5:
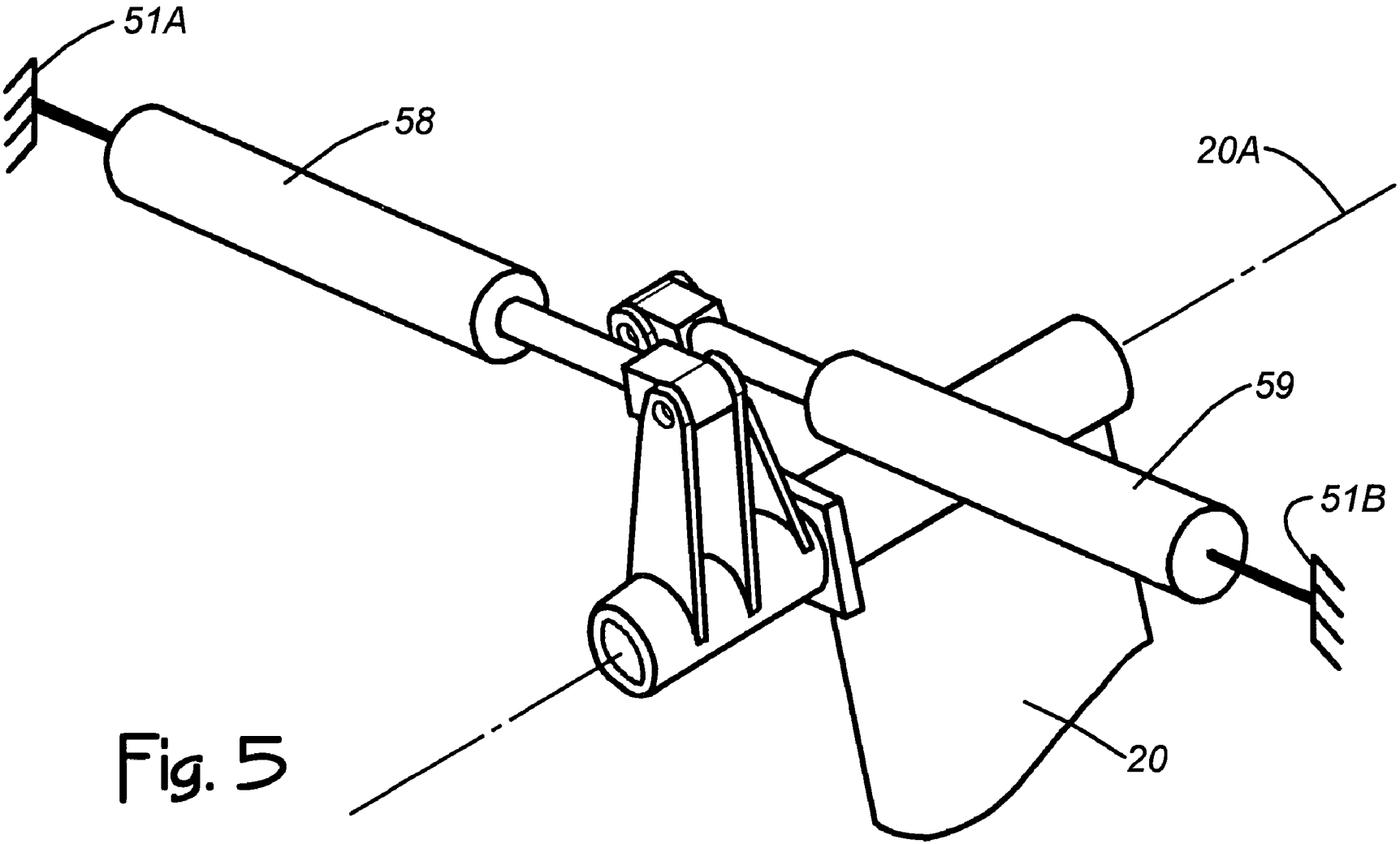
FIG. 5 is a perspective view of the strut portion with dual hydraulic cylinders arranged another way for push-pull operation.

FIG. 5 shows first and second hydraulic cylinders 58 and 59 connected to the strut portion 20 and to first and second hull portions 51A and 51B as described for the first and second hydraulic cylinders 18 and 19 in FIG. 2. They are also connected by hydraulic lines and to the valving 23, and those details are omitted for illustrative convenience. The first and second hydraulic cylinders 58 and 59 are also arranged for push-pull operation.

Figure 6:
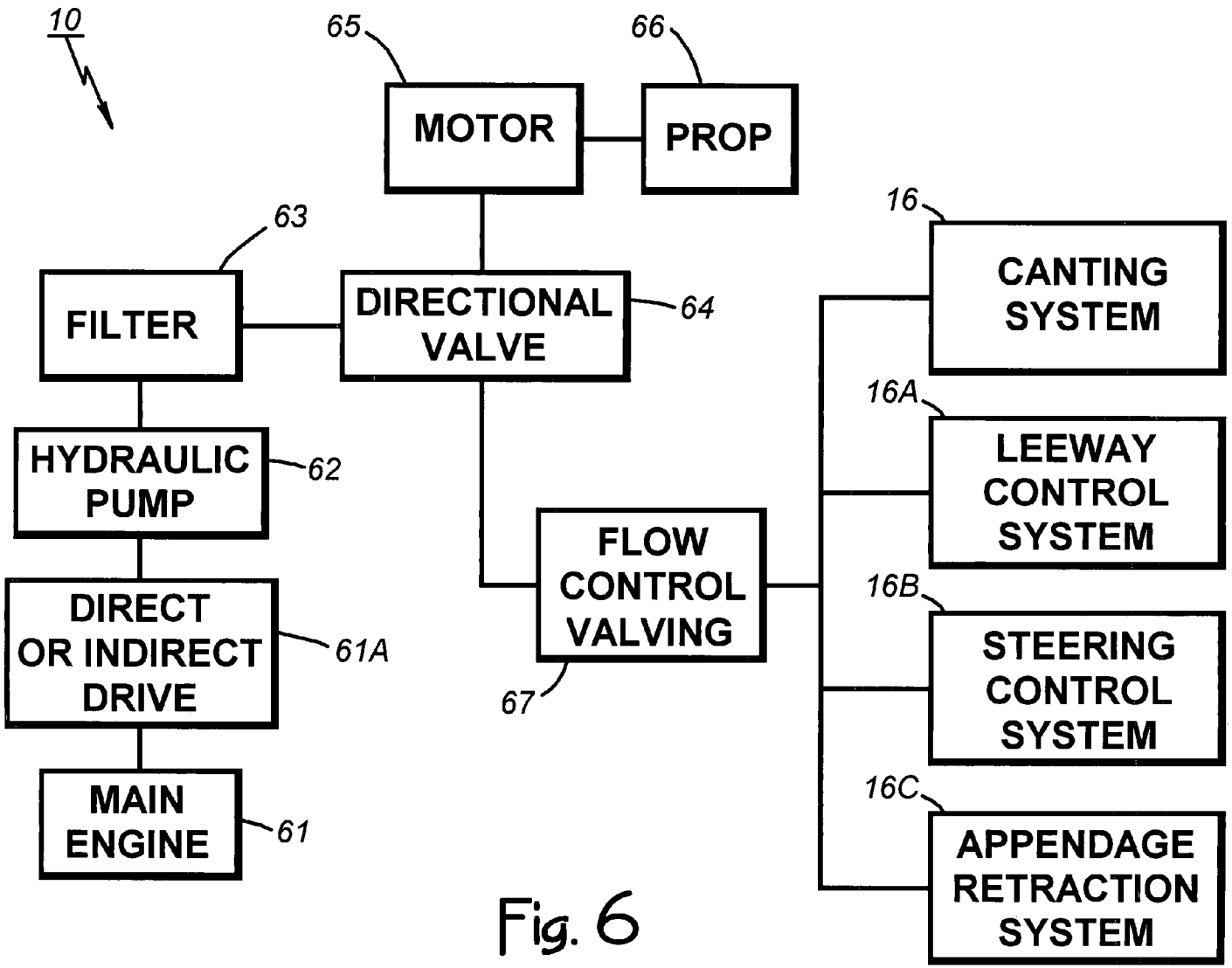
FIG. 6 is a block diagram of a main engine driven hydraulic source for the onboard ballast drive system.

Main Engine Drive System. With regard to the drive system, the sailing yacht 10 also includes a main engine ballast drive system 60 onboard the sailing hull 11 as depicted generally in FIG. 1 and in more detail in the block diagram form in FIG. 6. A main engine 61 onboard the sailing yacht 10 (e.g., a diesel or gasoline engine) drives a hydraulic motor pump 62 that pumps hydraulic fluid via a conventional in-line filter 63 to a directional valve 64 (FIG. 6). The hydraulic motor pump 62 is driven directly by suitable mechanical coupling to the main engine 61, or indirectly through a battery/electric system onboard the yacht 10 whereby the main engine 61 drives a charging device (not shown) that charges an onboard battery (not shown) that powers an electric form of the hydraulic motor pump 62. The block 61A in FIG. 6 is intended to represent either of those two alternatives. The directional valve 64 (e.g., manually or electrically operated) couples the hydraulic fluid to one or both of two hydraulic line branches that are operator selected by operation of the directional valve 64.

The first hydraulic line branch couples the hydraulic fluid from the directional valve 64 to a hydraulic motor 65 that drives a yacht-propelling propeller 66. The second hydraulic line branch couples the hydraulic fluid from the directional valve 64 to a flow control valving component 67 that couples the hydraulic fluid to the valving 23 of the onboard ballast drive system 16 discussed earlier, and/or to a leeway control system 16A and/or a steering control system 16B that are depicted in block diagram form in FIGS. 6, 7, and 8. As described earlier, the valving 23 controls the flow of the hydraulic fluid to the first and second hydraulic cylinders 18 and 19 in order to move the ballast 12 and thereby vary the counter-heeling force. The valving 23 also controls the flow of the hydraulic fluid to the leeway control system 16A for leeway control and to the steering control system 16B for steering control. Based upon the foregoing and subsequent descriptions, one of ordinary skill in the art can readily implement a main engine drive system with or without said system powering a yacht-propelling propeller.

Figure 7:
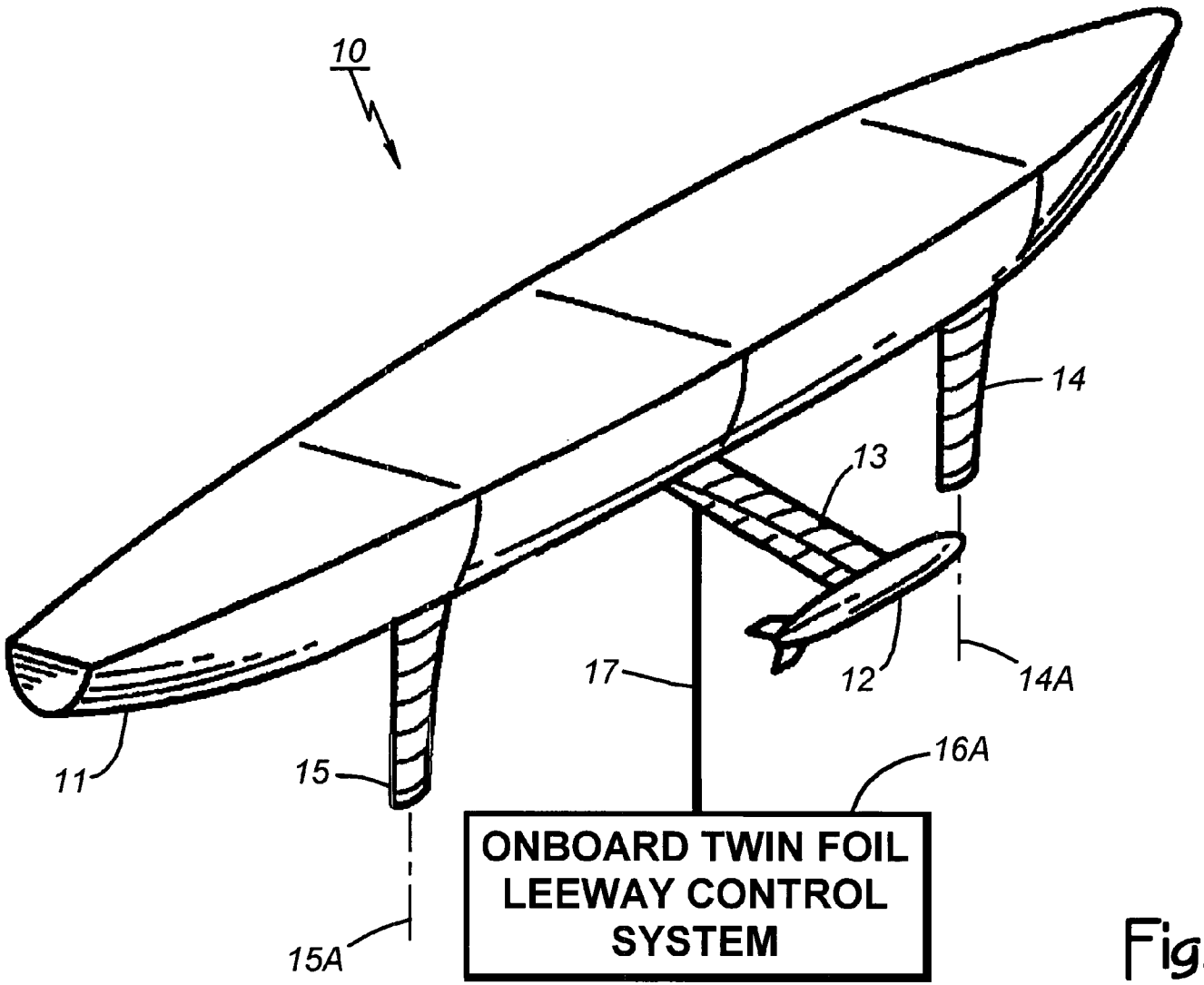
FIG. 7 is a diagrammatic representation similar to FIG. 1 of the CBTF sailing yacht that shows a twin foil onboard leeway control system.
Figure 8:
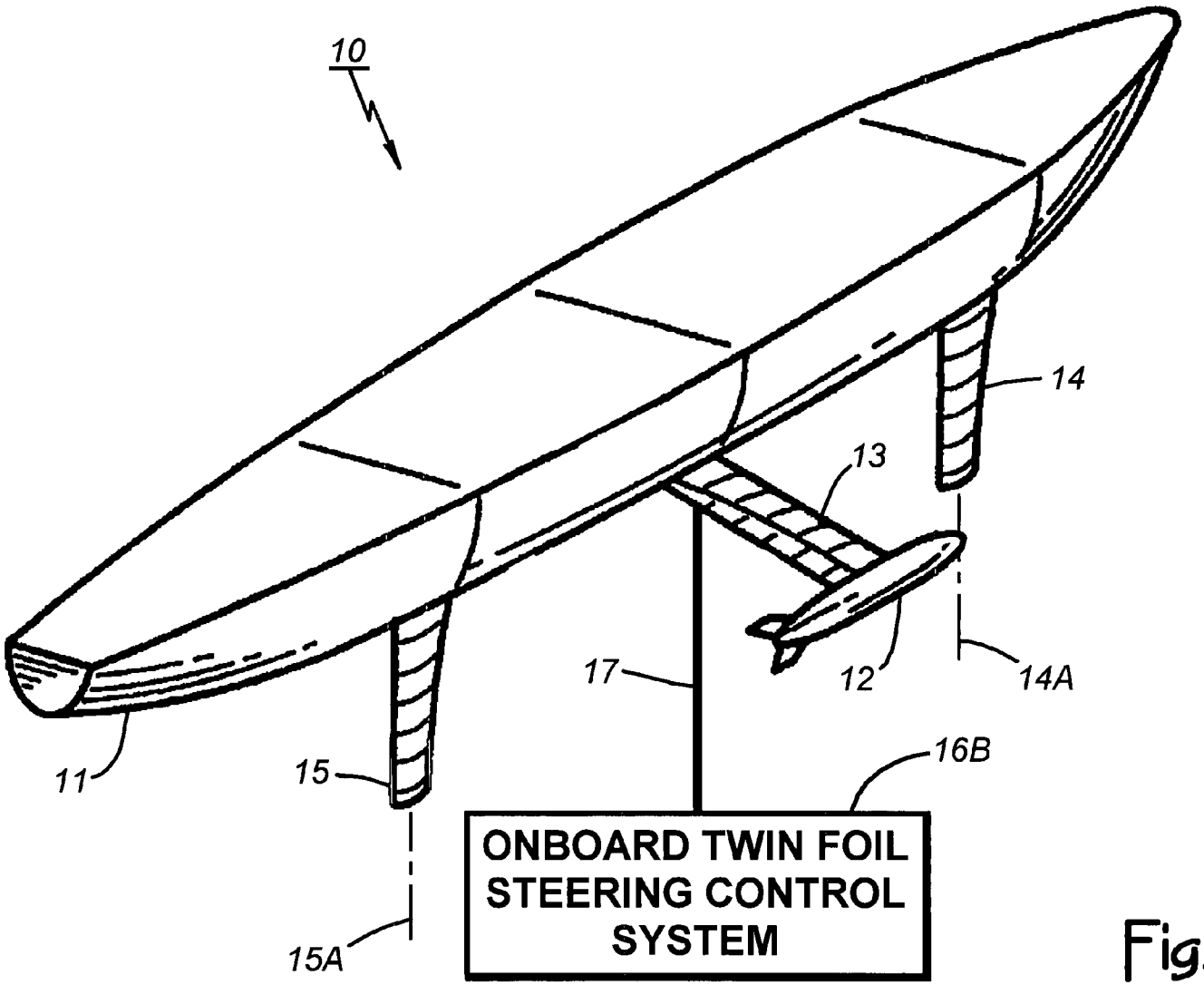
FIG. 8 is a diagrammatic representation similar to FIG. 1 of the CBTF sailing yacht that shows a twin foil steering system.
Figure 9:
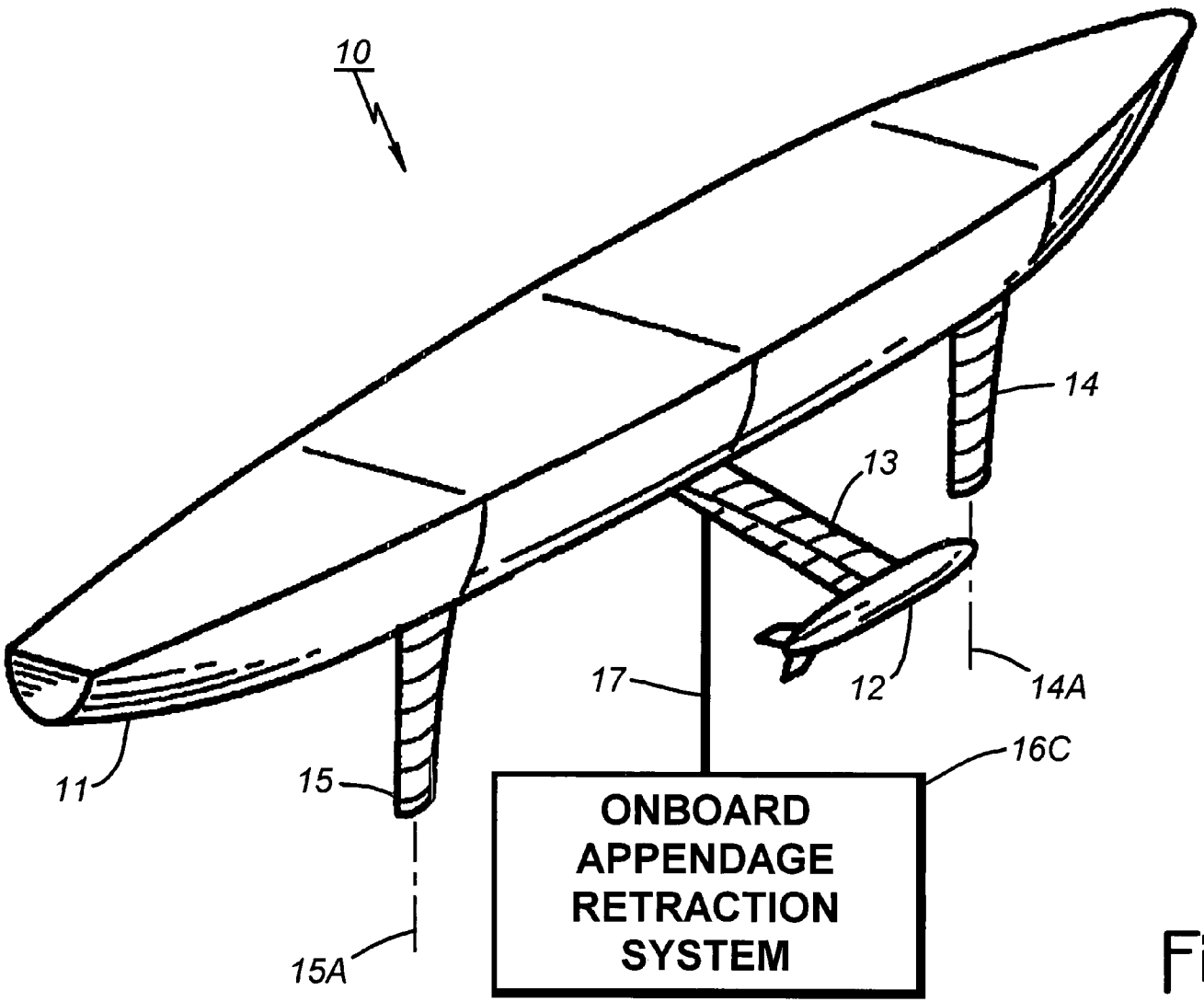
FIG. 9 is a diagrammatic representation similar to FIG. 1 of the CBTF sailing yacht that shows an onboard appendage retraction system.

The fore and aft foils 14 and 15 depend downwardly from the hull 11, each being mounted on the hull 11 for rotation about (i.e., pivotal movement about) a respective one of a fore axis 14A (that is disposed forward of the ballast 12 and the ballast-supporting structure or strut 13) and an aft axis 15A disposed rearward of the ballast 12 and the ballast-supporting structure 13 (FIGS. 7 and 8). The fore and aft foils 14 and 15 depend downwardly and generally into bow and stern waves produced by the hull 11. They are so constructed that they provide the principal resistance to leeway for the yacht 10. Preferably, an appendage retraction system 16C (FIG. 6) is included for retracting at least one of the ballast-supporting strut 13, the fore foil 14, and the aft foil 15 at least partially into the hull 11 while underway.

The leeway control system 16A includes means for rotating the fore and aft foils 14 and 15 together in the same direction (i.e., counterclockwise to port and clockwise to starboard. It includes a hydraulic system powered by the main engine drive either directly by suitable coupling or indirectly by a battery/electric system with battery recharging by the main engine drive as described above for the ballast drive system 16. The leeway control system 16A rotates the fore and aft foils 14 and 15 together by means of a suitable mechanical, hydraulic, or electrical linkage between the fore and aft foils 14 and 15, or by independent means, including, for example, hydraulic or electrical systems. FIGS. 6 and 7 show a hydraulic leeway system 16A.

The steering control system 16B includes means for rotating the fore and aft foils 14 and 15 together in opposite ones of clockwise and counterclockwise directions for improved steering control. In other words, it rotates the fore foil 14 to port (counterclockwise about the fore axis 14A view from above) as it rotates the aft foil 15 to starboard, and it rotates the fore foil 14 to starboard (clockwise about the fore axis 14A view from above) as it rotates the aft foil 15 to port. It includes a hydraulic system powered by the main engine drive either directly by suitable coupling or indirectly by a battery/electric system with battery recharging by the main engine drive as described above for the ballast drive system 16. The steering control system 16B rotates the fore and aft foils 14 and 15 together by means of a suitable mechanical, hydraulic, or electrical linkage between the fore and aft foils 14 and 15, or by independent means including hydraulic or electrical systems. FIGS. 6 and 8 show a hydraulic steering control system 16B.

Appendage Retraction System. Now consider the appendage retraction system details illustrated in FIGS. 9-12. The appendage retraction system 16C mentioned previously with reference to FIG. 6 is shown in block diagram form in FIG. 9. A manually powered appendage retraction system may be provided within the broader inventive concepts disclosed, but the illustrated appendage retraction system 16C is otherwise powered. Various components of the appendage retraction system 16C are shown in block diagram form in FIG. 10. The fore foil axis 14A and the aft foil axis 15A are usually disposed vertically when the sailing yacht 10 is at rest. The ballast-supporting strut 13 extends along a strut axis 13A that is also usually disposed vertically when the sailing yacht 10 is at rest, although it is illustrated inclined in FIG. 10. The appendage retraction system operates to vertically retract operator selected ones of the strut 13 and the fore and aft foils 14 and 15 (i.e., appendages 13, 14, and 15) at least partially into the hull 11 along corresponding ones of the axes 13A, 14A, and 15A.

Based upon the foregoing and subsequent descriptions, one of ordinary skill in the art can readily implement the invention using various types and kinds of retractor components. The illustrated appendage retractor system 16C includes operator controls 71 shown in block diagram form in FIG. 10. The operator controls 71 may take the form of a laptop computer, for example, although any of other suitable analog and/or digital control circuits may be used to enable an operator to control the appendage retractor system 16C.

Figure 10:
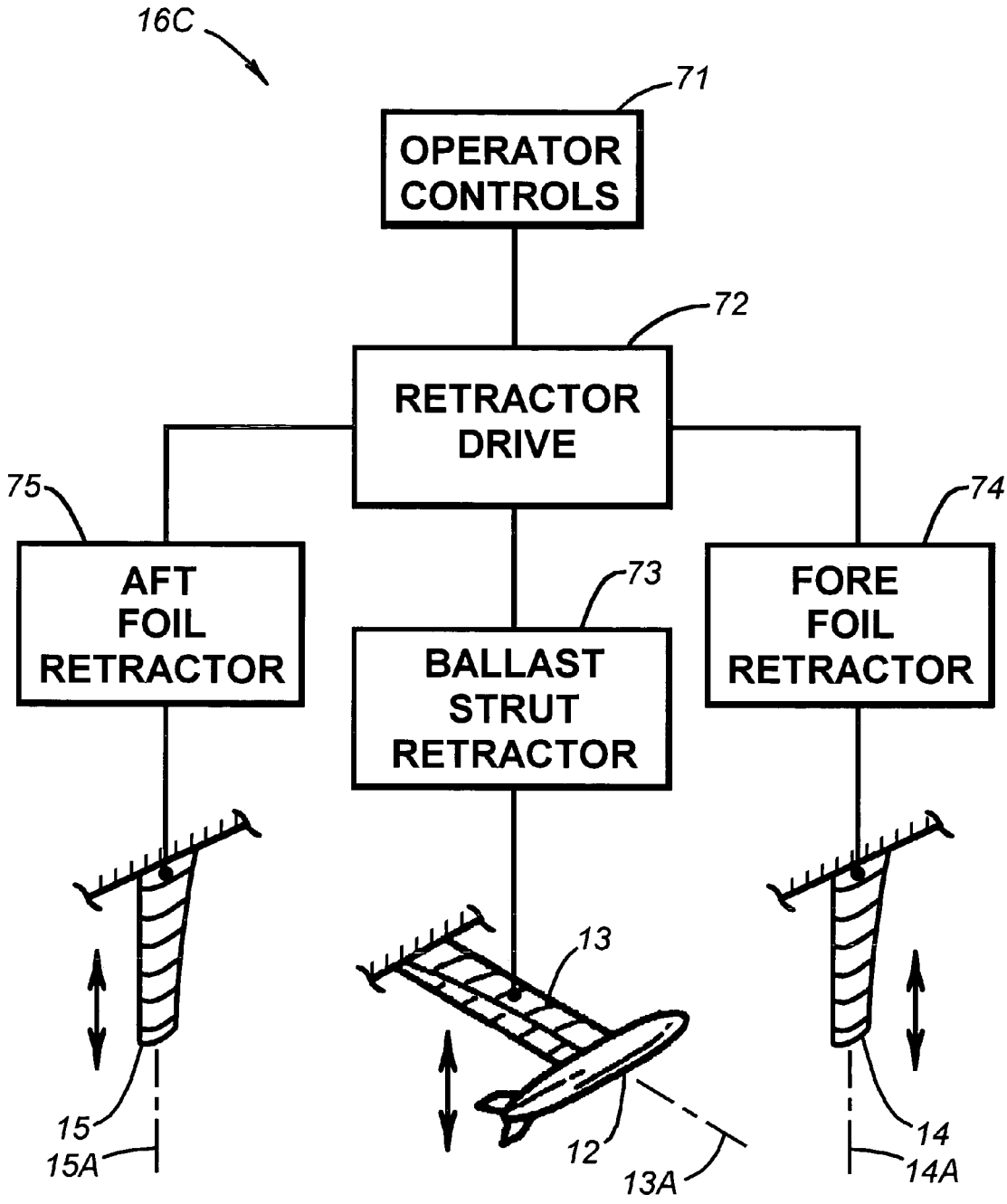
FIG. 10 is a block diagram of the appendage retraction system.

The operator controls 71 control a retractor drive component 72 shown in block diagram form in FIG. 10. The retractor drive component 72 takes the form of a hydraulic or electric component that drives a ballast strut retractor component 73, a fore foil retractor component 74, and an aft foil retractor component 75. Each of the retractor components 73, 74, and 75 takes the form of suitable hydraulic or electric components with suitable mechanical linkages to the appendages 13, 14, and 15 to function as means for retracting selected ones of the appendages 13, 14, and 15. For a manually powered system, retractor components are provided that include suitable mechanical linkages for enabling an operator to retract those appendages manually.

Figure 11:
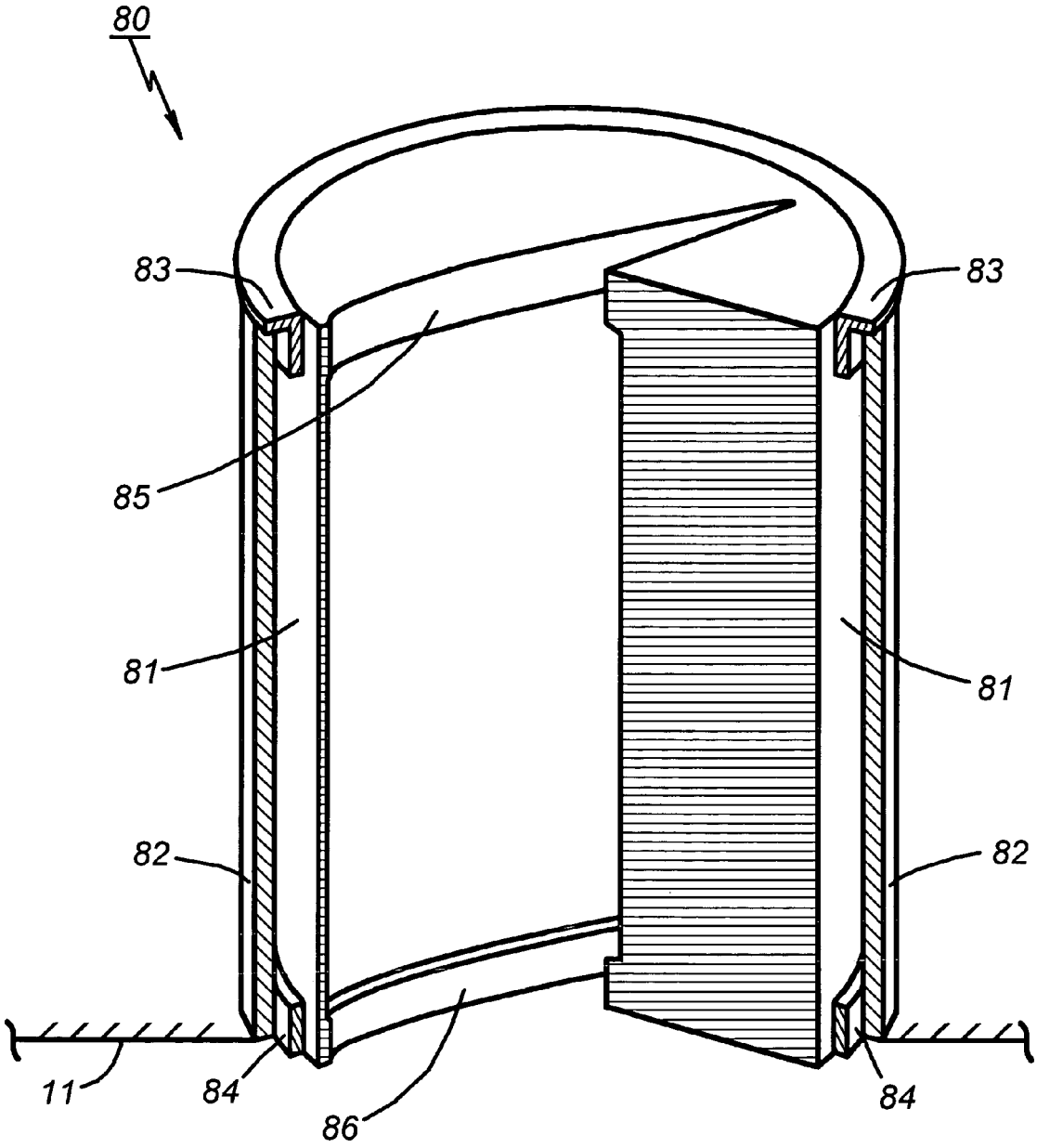
FIG. 11 is an enlarged view of a portion of the fore foil bushing assembly without the fore foil in place.
Figure 12:
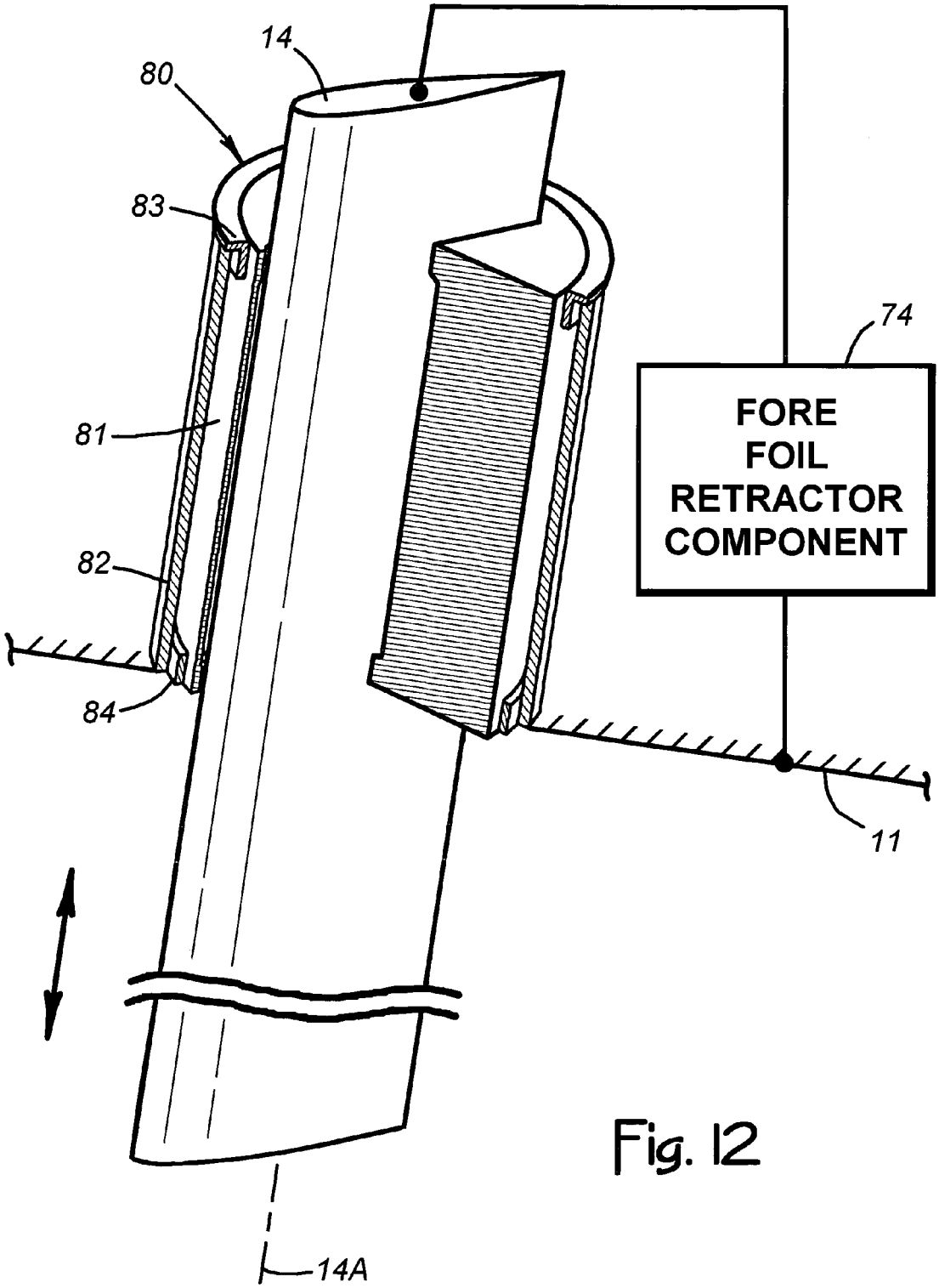
FIG. 12 is a somewhat smaller view of the same portion of the fore foil bushing assembly with the fore foil in place.

The appendages 13, 14, and 15 are mounted in bushing assemblies that allow movement along the axes 13A, 14A, and 15A while providing a seal. Some bushing assembly details are illustrated in FIGS. 11 and 12 for a bushing assembly 80 that is used for the fore foil 14. A similar bushing assembly is used for the aft foil 15 and a suitable bushing assembly is used for the strut 13.

The bushing assembly 80 extends in a fixed position through the hull 11 while the fore foil 14 extends moveably through the bushing assembly 80. The bushing assembly 80 is shown with a portion broken away in order to expose the interior and show the relationship of its various components. The bushing assembly 80 includes a displacement fairing 81 mounted rotatable within a foil tube 82 using upper and lower bearings 83 and 84. The fairing 81 includes an upper bushing surface 85 and a lower bushing surface 86.

With the fore foil 14 in position within the bushing assembly 80 as shown in FIG. 12, the upper and lower bushing surfaces 85 and 86 bear against the fore foil 14 in order to provide a seal while permitting axial movement of the fore foil 14 along the axis 14A (as indicated by the double headed arrow in FIG. 12). The upper and lower bearings 83 and 84 enable rotational movement of the fore foil 14 about the axis 14A. Stated another way, the fore foil bushing assembly 80 includes means for allowing axial movement of the fore foil 14 while providing fluid-flow-limiting engagement of the fore foil 14 so that the hull 11 does not take on significant water through the fore foil bushing assembly 80, said means including a tube 82 (a first tube) and a fairing 81 (a first fairing) mounted rotatably within the tube 82 so that the fairing 81 bears against the fore foil 14 in order to provide a seal while permitting axial movement of the fore foil 14. The fore foil retractor component 74 is connected mechanically to the hull 11 (FIG. 12) and to the fore foil 14 so that operation of the fore foil retractor component 74 causes the fore foil 14 to move axially along the axis 14A for purposes of deployment from and retraction into the hull 11. As stated above, a bushing assembly (an aft foil bushing assembly similar to the fore foil bushing assembly 80) is provided for the aft foil 15. A separate aft foil bushing assembly is not illustrated because it is similar to the illustrated fore foil bushing assembly 80. The illustrations in FIGS. 11 and 12 for the fore foil assembly 80 are intended to apply for the aft foil bushing assembly also. Thus, as recited in the claims, the aft foil bushing assembly (i.e., the aft counterpart of the fore foil bushing assembly 80) includes means for allowing axial movement of the aft foil 15 while providing fluid-flow-limiting engagement of the aft foil 15 so that the hull 11 does not take on significant water through the aft foil bushing assembly, said means including a second tube (the aft counterpart of the first tube 82) and a second fairing (the aft counterpart of the first fairing 81) mounted rotatably within the second tube such that the second fairing bears against the aft foil 15 in order to provide a seal while permitting axial movement of the aft foil 15. As is apparent from the drawings and this description, the above is accomplished without a gasket seal or sealing lips between the first fairing and the fore foil and without a gasket seal or sealing lips between the second fairing and the aft foil.

Thus, the invention provides a sailing yacht with structural improvements in the form of an onboard appendage retraction system that overcome some significant disadvantages of prior art canting ballast and foil systems while providing functionality that enhances sailing yacht operation. Although exemplary embodiments have been shown and described, one of ordinary skill in the art may make many changes, modifications, and substitutions without necessarily departing from the spirit and scope of the invention.

What is claimed is:

1. A sailing yacht, comprising:

a hull;

a fore foil mounted on the hull for rotational movement about a fore axis and axial movement along the fore axis; and means for at least partially retracting the fore foil into the hull along the fore axis while underway, including a fore-foil-retracting assembly;

wherein the fore-foil-retracting assembly includes a fore foil bushing assembly on the hull through which the fore foil extends moveably for axial movement of the fore foil along the fore axis relative to the fore foil bushing;

wherein said fore foil bushing assembly is mounted rotatably on the hull for rotation with the fore foil about the fore axis so that partial retraction of the fore foil axially does not prevent rotation of the fore foil about the fore axis;

wherein the fore foil bushing assembly includes means for allowing axial movement of the fore foil, said means including a tube and a fairing mounted rotatably within the tube such that the fairing bears against the fore foil in order to provide a seal while permitting axial movement of the fore foil;

wherein the fore foil bushing assembly includes first and second bearings disposed intermediate the fairing and the tube, said first and second bearings being spaced apart from each other along a direction parallel to the fore axis; and wherein the fairing includes upper and lower bushing surfaces that bear against the fore foil, said upper and lower bushing surfaces being spaced apart from each other along a direction parallel to the fore axis.

2. A sailing yacht as recited in claim 1, further comprising means for moveably supporting a ballast beneath the hull, including a moveable ballast-supporting strut on the hull.

3. A sailing yacht, comprising:

a hull;

an aft foil mounted on the hull for rotational movement about an aft axis and axial movement along the aft axis; and means for at least partially retracting the aft foil into the hull along the aft axis while underway, including an aft-foil-retracting assembly;

wherein the aft-foil-retracting assembly includes an aft foil bushing assembly on the hull through which the aft foil extends moveably for axial movement of the aft foil along the aft axis relative to the aft foil bushing;

wherein said aft foil bushing assembly is mounted rotatably on the hull for rotation with the aft foil about the aft axis so that partial retraction of the aft foil axially does not prevent rotation of the aft foil about the aft axis;

wherein the aft foil bushing assembly includes means for allowing axial movement of the aft foil, said means including a tube and a fairing mounted rotatably within the tube such that the fairing bears against the aft foil in order to provide a seal while permitting axial movement of the aft foil;

wherein the aft foil bushing assembly includes first and second bearings disposed intermediate the fairing and the tube, said first and second bearings being spaced apart from each other along a direction parallel to aft axis; and wherein the fairing includes upper and lower bushing surfaces that bear against the aft foil, said upper and lower bushing surfaces being spaced apart from each other along a direction parallel to the aft axis.

4. A sailing yacht as recited in claim 3, further comprising means for moveably supporting a ballast beneath the hull, including a moveable ballast-supporting strut on the hull.

5. A sailing yacht, comprising:

a hull;

a fore foil mounted on the hull for rotational movement about a fore axis and axial movement along the fore axis;

an aft foil mounted on the hull for rotational movement about an aft axis and axial movement along the aft axis;

means for at least partially retracting the fore foil into the hull along the fore axis while underway, including a fore-foil-retracting assembly; and means for at least partially retracting the aft foil into the hull along the aft axis while underway, including an aft-foil-retracting assembly;

wherein the fore-foil-retracting assembly includes a fore foil bushing assembly on the hull through which the fore foil extends moveably for axial movement of the fore foil along the fore axis relative to the fore foil bushing, said fore foil bushing assembly being mounted rotatably on the hull for rotation with the fore foil about the fore axis so that partial retraction of the fore foil axially does not prevent rotation of the fore foil about the fore axis, thereby to enable rotational operation of the fore foil when the fore foil is partially retracted;

wherein the aft-foil-retracting assembly includes an aft foil bushing assembly on the hull through which the aft foil extends moveably for axial movement of the aft foil along the aft axis relative to the aft foil bushing, said aft foil bushing assembly being mounted rotatably on the hull for rotation with the aft foil about the aft axis so that partial retraction of the aft foil axially does not prevent rotation of the aft foil about the aft axis;

wherein the fore foil bushing assembly includes means for allowing axial movement of the fore foil, said means including a first tube and a first fairing mounted rotatably within the first tube such that the first fairing bears against the fore foil in order to provide a seal while permitting axial movement of the fore foil;

wherein the fore foil bushing assembly includes first and second bearings disposed intermediate the first fairing and the first tube, said first and second bearings being spaced apart from each other along a direction parallel to the fore axis;

wherein the first fairing includes upper and lower fore foil bushing assembly bushing surfaces that bear against the fore foil, said upper and lower fore foil bushing assembly bushing surfaces being spaced apart from each other along a direction parallel to the fore axis;

wherein the aft foil bushing assembly includes means for allowing axial movement of the aft foil, said means including a second tube and a second fairing mounted rotatably within the second tube such that the second fairing bears against the aft foil in order to provide a seal while permitting axial movement of the aft foil;

wherein the aft foil bushing assembly includes first and second aft foil bushing assembly bearings disposed intermediate the second fairing and the second tube, said first and second aft foil bushing assembly bearings being spaced apart from each other along a direction parallel to the aft axis; and wherein the second fairing includes upper and lower aft foil bushing assembly bushing surfaces that bear against the aft foil, said upper and lower aft foil bushing assembly bushing surfaces being spaced apart from each other along a direction parallel to the aft axis.

* * * * *